US007699083B1

(12) United States Patent
Kim

(10) Patent No.: US 7,699,083 B1
(45) Date of Patent: Apr. 20, 2010

(54) GOLF CLUB HEAD COVER WITH MAGNETIC CLOSURE

(76) Inventor: Hoseong Kim, Cheriville C-1701, Sinjung-Donit, Yangchun-ku, Seoul (KR)

( * ) Notice: Subject to any disclaimer, the term of this patent is extended or adjusted under 35 U.S.C. 154(b) by 1071 days.

(21) Appl. No.: 11/375,959

(22) Filed: Mar. 15, 2006

Related U.S. Application Data

(60) Provisional application No. 60/661,715, filed on Mar. 15, 2005.

(51) Int. Cl.
*A63B 55/00* (2006.01)

(52) U.S. Cl. ..... 150/160; 24/303; 206/818

(58) Field of Classification Search ..... 150/160; D21/754; 24/303; 206/818
See application file for complete search history.

(56) References Cited

U.S. PATENT DOCUMENTS 4,368,768 A * 1/1983 Cunko, Jr. ..... 150/160
2005/0016648 A1* 1/2005 Vakharia et al. ..... 150/160
2006/0201596 A1* 9/2006 Hwang ..... 150/160
2007/0068611 A1* 3/2007 Hwang ..... 150/160

* cited by examiner

*Primary Examiner*—Tri M Mai
(74) *Attorney, Agent, or Firm*—Young Basile

(57) ABSTRACT

A golf club head cover is provided with an essentially flexible, non-rigid material construction forming a cavity therein. An elongate opening is provided to the cavity, wherein the opening has a non-linear configuration when the opening is in either the open position, closed position, or both. A seam extends adjacent both edges of the opening forming piping edges next to the opening. A flexible magnetic strip is positioned within the entire length of each of the piping edges adjacent the opening. The flexible magnetic strips are a continuous flat or cylindrical strip that curve around the non-linear configuration of the opening. The strips having magnetic properties along the entire length of the strips.

5 Claims, 3 Drawing Sheets

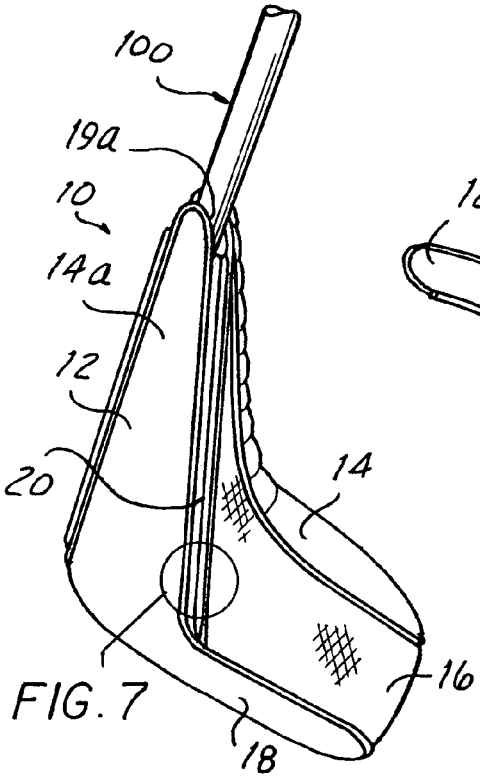
FIG. 7
FIG. 1A
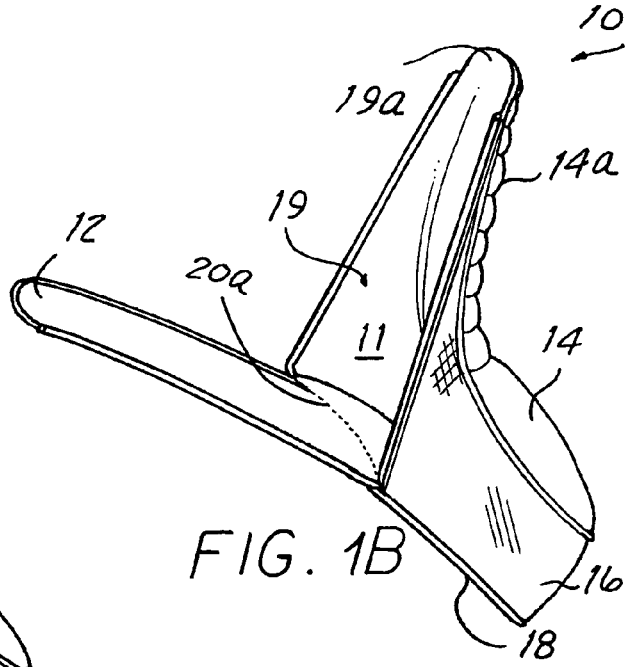
FIG. 1B
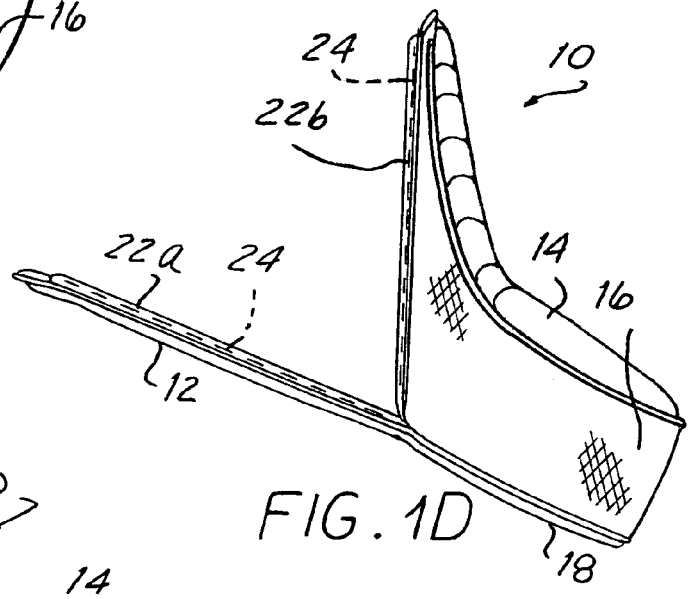
FIG. 1D
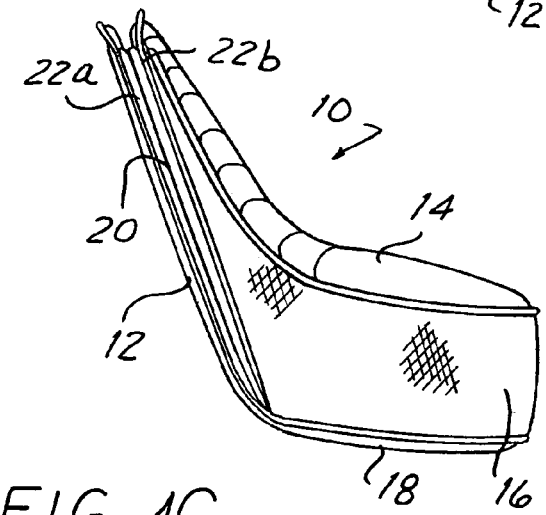
FIG. 1C
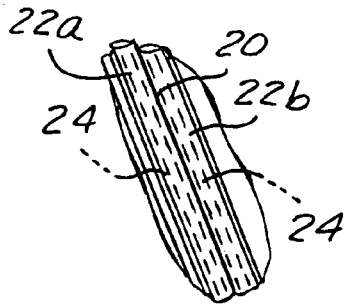
FIG. 7

GOLF CLUB HEAD COVER WITH MAGNETIC CLOSURE

This application claims priority of U.S. Provisional Patent Application Ser. No. 60/661,715 filed on Mar. 15, 2005.

FIELD OF THE INVENTION

The invention pertains to a golf club head cover with a magnetic closure.

BACKGROUND

Golf club head covers have been used for numerous years to protect the head of golf clubs, especially the wood clubs, from hitting other clubs within the golf bag during the transport of the golf clubs. Typically, the head cover is made of a soft, plush or padded material that extends over and around the golf club head. The golf club head cover may also extend over a portion of the shaft or may be connected to a narrow band of highly elasticized material that extends over a portion of the shaft. One purpose of the narrow band of highly elasticized material that extends over a portion of the shaft is to provide a closure means for the golf club head so that it cannot easily or inadvertently be removed from the golf club head cover. Although a portion of the shaft is also protected by the narrow band of highly elasticized material of the golf club head cover, in many cases this protection is not necessary. Thereby eliminating this narrow band of highly elasticized material helps to minimize the cost of the golf club head cover. However, it presents another problem of how to prevent the golf club head from being inadvertently dislodged from the head cover by providing a closure that is aesthetic and allows for quick and easy storage and retrieval of the golf club head.

SUMMARY OF THE INVENTION

An improvement is provided for a golf club head cover having an essentially flexible, non-rigid material construction forming a cavity therein. The construction has at least a first panel and adjacent panel connected together at seams. An opening is provided between the first and adjacent panels for receiving the golf club head therethrough for storage of the golf club head in the cavity. The opening has an elongate configuration which includes a non-linear configuration in at least when the opening is in either an opened or closed position. The golf club head cover also has a closure for the opening wherein the improvement includes a single magnetic strip enclosed in a seam at one edge of the opening and another single magnetic strip of opposite polarity enclosed in an adjacent seam at the other edge of the opening, wherein each of the single magnetic strips is flexible to follow the non-linear configuration.

BRIEF DESCRIPTION OF THE DRAWINGS

The description herein makes reference to the accompanying drawings wherein like reference numerals refer to like parts throughout the several views, and wherein:

FIGS. 1A and 1B are perspective views of the golf club head cover having a fastener according to the first embodiment in a closed and open position respectively;

FIGS. 1C and 1D are side elevational views of the golf club head cover as shown in FIGS. 1A and 1B;

FIG. 7 shows an enlarged view of the fastener shown encircled in FIG. 1A.

DETAILED DESCRIPTION OF THE PREFERRED EMBODIMENT

Figure 2A:
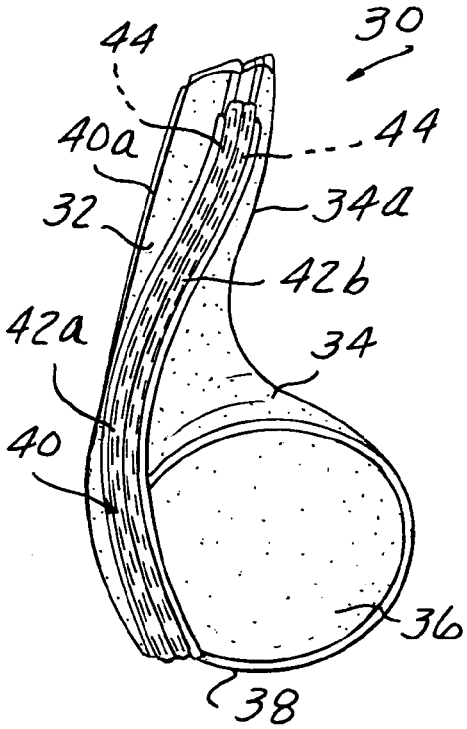
FIGS. 2A, and 2B are perspective views of a second embodiment of the golf club head cover having a fastener according to the second embodiment of the inventions in a closed and open position respectively.

FIGS. 1A through 6B show various golf club head cover configurations, particularly for wood golf clubs and putters. The golf club head covers 10 shown in the first embodiment of FIGS. 1A through 1D form a cavity 11 therein and includes a back panel 12, a top or front panel 14, a pair of sidewall panels 16 (only one side shown), and a bottom panel 18. The back, front and sidewall panels form a body portion for the golf club head and an elongate neck portion 14*a* for a portion of a shaft 100. Each panel is otherwise connected to an adjacent panel at a sewn seam. The back panel 12 is selectively connected to the sidewall panels 16 along each lateral edge of the back 12 to form the opening 19. The selectively connected seam 20 at the opening 19 is formed by a pair of material strips 22 *a,b* doubled over and stitched form piping for an enclosure there between to house a flexible magnetic strip 24, as shown in FIG. 7. The material strips 22 *a,b* may be an edge of one of the front and back panels or a separate material strip 22 *a,b* stitched to the edges of the panels. Preferably a foam material is used as the material strips 22 *a,b*. The foam material can be used for one or more of the panels to provide a cushion for the golf club head.

Each material strip 22 *a,b* is connected to its respective section of the golf club head cover. For example, in the first embodiment the material strip 22*a* is connected to the back panel 12 and material strip 22*b* is connected to the sidewall 16. Each material strip 22*a* and 22*b* house a single elongate flexible magnetic strip 24 of opposite polarity. The magnetic strips 24 attract each other when placed close together to close access to the cavity 11. The seam 20 is formed along each lateral edge of the back panel 12 so that the back panel 12 and the seams 20 can be separated when the magnetic strips 24 in the material strips 22*a* and 22*b* are disengaged. The seam 20*a* connecting the back panel 12 to the bottom panel 18 secure the back panel 12 to the golf club head cover. The back panel 12 is dislodged from the side panels 16 of the golf club head.

Flexible magnet strips 24 are a known component generally made of a dry mixture of ferrite powder and rubber polymer resin that is mixed, calendered, and ground. Magnetic strips 24 are then formed generally by extrusion. The material is then magnetized. Flexible magnets have the advantage of being capable of being coiled, twisted, or cut into shapes without loss of magnetic capability. The flexible magnetic strips 24 are preferably continuous and contiguous flat strips, although the strip may also be continuous and contiguous cylindrical strips. One source of the flat flexible magnetic strips is Master Magnetics, Inc. manufactured in Ohio.

The use of flexible magnetic strips 24 on golf club head covers provides advantages not available with other closure methods. The magnetic strips 24 allow for quick entry and removal of the golf club to and from the cover 10. Wherein, a zipper closure increases the weight of the golf club head cover as well as the time and effort to retrieve and store the golf club 100. In the embodiment shown in FIGS. 1A-1D, the golf club head cover 10 would require two zippers to accomplish the same function as the magnetic strip in the present invention which would double the time and effort. Another advantage is that the magnetic strips 24 do not detract from the aesthetic appearance of the golf club head covers. Because the magnetic strips 24 are enclosed in the piping 22*a, b* of the cover, the magnetic strips 24 are not visible, but yet functional. Zippers and hook and eye devices such as Velcro® strips, must be located on the exterior of the cover in order to be functional. Further the flexible magnetic strips 24 are continuously magnetized over the entire length of the strip so that the seam provides no unsecured gaps to allow rain or debris from entering the cavity 11 of the cover 10. Buttons and other similar fasteners do not provide continuous closure. Yet another advantage of the flexible magnetic strips 24 is that the strips are flexible and can follow the curvature of a seam whether the opening is in a closed or open position. The advantage provides for unique and varying entries for storing the golf club head in the cover while maintaining the contours of the golf club head. One such unique entry was shown in the first embodiment. Other golf club head covers having varying opening will be discussed hereafter.

Figure 2B:
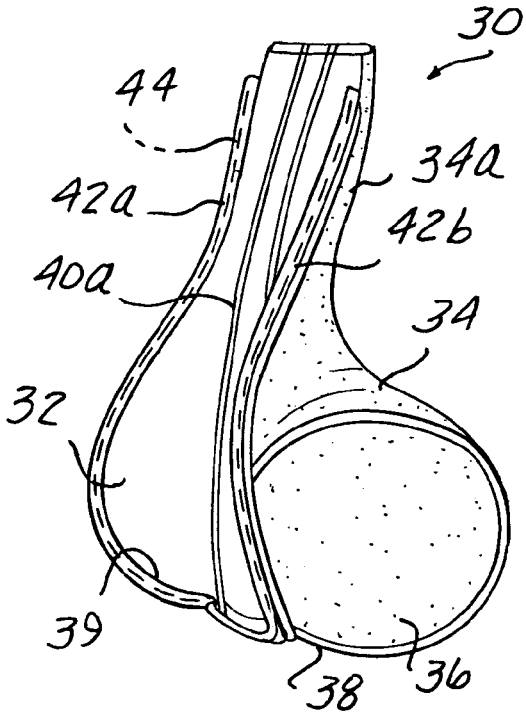

FIGS. 2A and 2B show a second embodiment having a configuration of a rear entry access of the golf club into the golf club head cover 30. The golf club head cover includes a back panel 32 attached to front and side panels 34, 36 respectively and a bottom panel 38. The bottom panel 38 may be a lower portion of the front panel 34. An upper portion of the front panel 34*a* may extend upward to form a neck of the golf club head cover 30. A seam 40 carrying flexible magnetic strips 44 within adjoining piping 42*a*, 42*b* extend along an internal edge and bottom edge of the back panel 32. The other lateral edge of the back panel 32 is stitched to the front and side panels, 34, 36 to form a seam 40*a* to secure the back panel 32 to the golf club head cover 30. As shown in phantom, a flexible strip 44 is positioned within material strip enclosure 42*a* and 42*b*. The assembly of the magnetic strip 44 in the material strip enclosures 42*a*, 42*b* is similar to that shown in FIG. 7. The material strips or piping 42*a* and 42*b* follow the curvature of the configuration as the seam extends from the neck 34*a* to the bottom 38 of the head cover. As can be seen in FIG. 2B, each single flexible magnet strip 44 can conform to the L-shaped or U-shaped curve of opening 39 to the club head cover 30 and extends essentially the length of the material strips 42*a*, 42*b*. The curved 42*a*, 42*b* allows for an easy rear or side entry for the golf club into the cover 30.

Figure 3A:
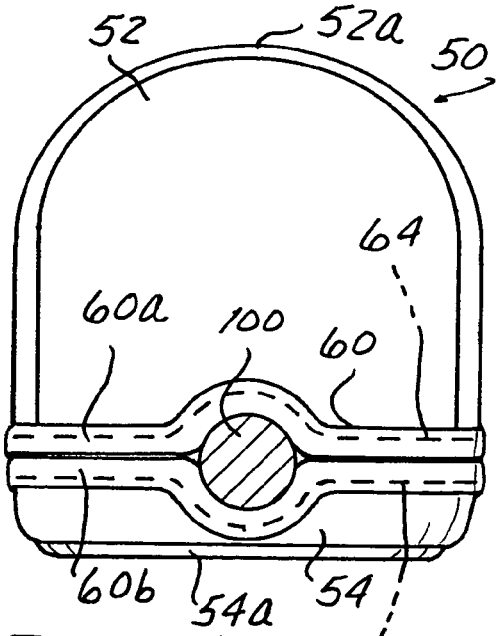
FIGS. 3A and 3B are elevational views of a third embodiment of the golf club head cover having a fastener according to the invention shown in a closed and open position respectively.
Figure 3B:
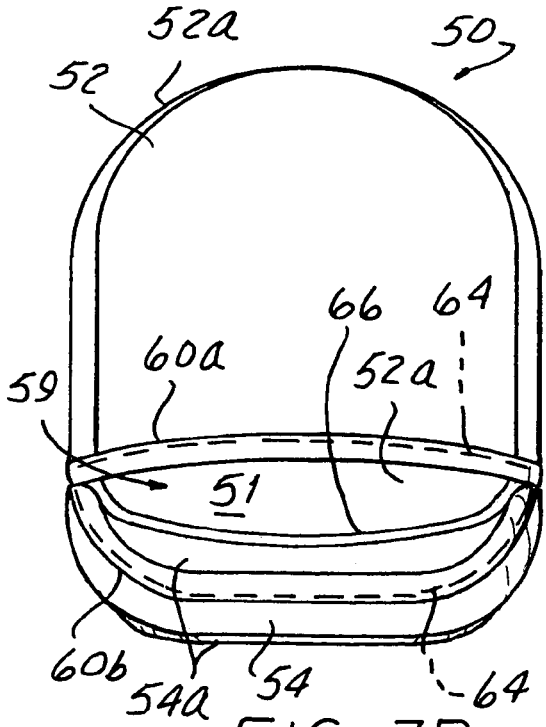

FIGS. 3A and 3B show a third embodiment for a golf club head cover 50 having a flexible magnet closure for use, in particular for a putter. The position of a putter shaft is shown at 100 in FIG. 3A. In the third embodiment, the head cover 50 has an elongate forward portion 52 to hold the putter head (preferably the larger portion of the head). The head cover 50 also had a rear portion 54. As can be seen in FIGS. 3A and 3B each of the forward and rear portions 52, 54 respectively can have trim 52*a*, 52*b* in the same or accent material. The trim 52*a*, 52*b* shown in FIG. 3A may extend into and form a portion of the back portion, as shown in FIG. 3B. The forward 52 and rear portions 54 are selectively connected together by a fastener 60 along a seam formed by material strips 60*a*, 60*b* which each enclose a single flexible magnetic strip 64 of opposite polarity. When the fastener 60*a*, 60*b* is disengaged, access to the interior cavity 51 is provided to retrieving or covering the putter head. A rear seam 66 is visible from the front of the cover 50 when the interior cavity 51 is accessible, as shown in FIG. 3B. When the putter is installed in the head cover 50, the material strips 60*a*, 60*b* and flexible magnetic strips 64 can curve and grip around the shaft 100 as shown in FIG. 3A. Although the opening 50 appears to be a linear opening in FIG. 3A, when the golf club head cover of the third embodiment is opened, the material strips 60*a*, 60*b* takes on a curvature that is followed by the flexible magnetic strip 64.

Figure 4A:
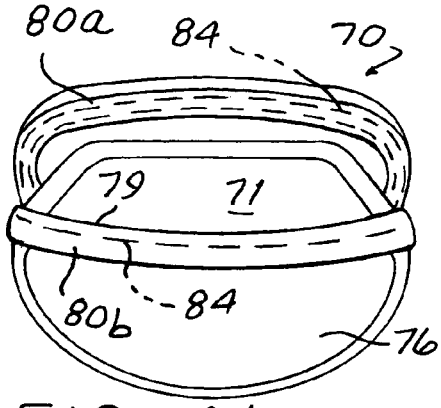
FIGS. 4A and 4B are elevational views of a fourth embodiment of the golf club head cover having a fastener according to the invention in an open and closed position respectively.
Figure 4B:
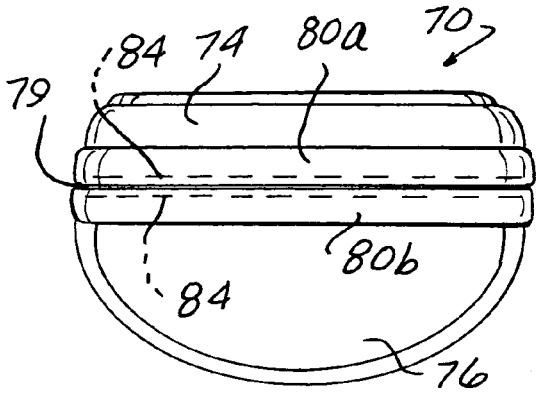

FIGS. 4A and 4B show a fourth embodiment of the golf club head cover 70 having a different configuration and particularly for use with a putter. The head cover 70 includes a single flexible magnetic strip 84 extending essentially the entire length of the pair of material strips 80*a* and 80*b* located at an opening 79 between a flap 74 and a body 76 of the head cover 70. The magnetic opening 79 in FIGS. 4A and 4B function similarly to the magnetic opening 59 as disclosed in FIGS. 3A and 3B, in that the flexible magnetic strips 84 can curve around to grip the shaft 100 when the golf club is stored in the cavity 71. When no golf club head is located in the cover, the magnet closure 79 has a linear configuration in the closed position (FIG. 4B). When the golf club head cover 70 is in the open position (FIG. 4A) the closure forms an oval configuration. The flexible magnetic strip 84 can easily conform to the curvature of the opening. An advantage of this embodiment is that with slight modification and sizing the cover can be used to store eyeglasses or sunglasses.

Figure 5A:
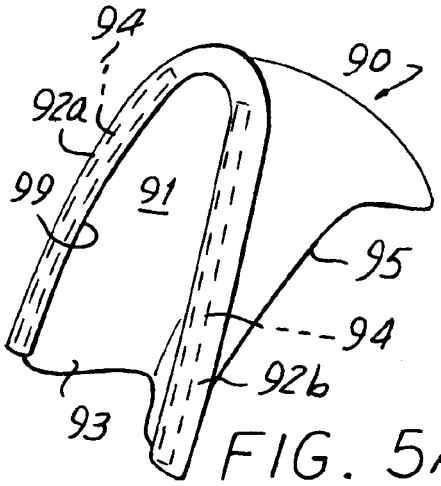
FIGS. 5A and 5B are front elevational views of a fifth embodiment of the golf club head cover having the fastener according to the invention shown in an open and closed position.
Figure 5B:
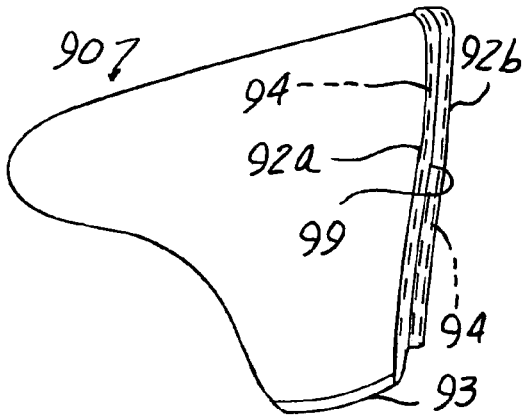

The fifth embodiment shown in FIGS. 5A and 5B show a one piece golf club head cover 90. The golf club 90 has a bottom opening for an exiting port 92 for the golf club shaft (not shown), and a back opening 99 for insertion of the golf club head. Along the peripheral edge of the back opening 99 are formed the material strips or piping 92*a* and 92*b* having the flexible magnetic strips 94 extending the length of the piping therein. The front portion 95 is stitched along the peripheral edge to provide the cavity 91 therein. When the golf club head cover 90 as shown in the fifth embodiment is in an open position (FIG. 5A), the opening 99 forms an oval opening in which the flexible magnetic strips 94 can curve to follow formation of the material strips or piping 92*a* and 92*b* without binding the material of the golf club head cover 90. FIG. 5B shows the cover 90 in the closed position, which only provides access to the cavity 91 via the exiting port 93 for the golf club shaft.

Figure 6A:
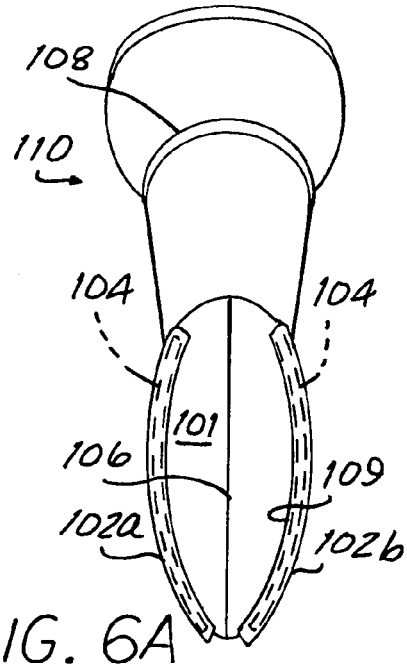
FIG. 6A is a front elevational view of a sixth embodiment of the golf club head cover having the fastener according to the invention shown in an open position.
Figure 6B:
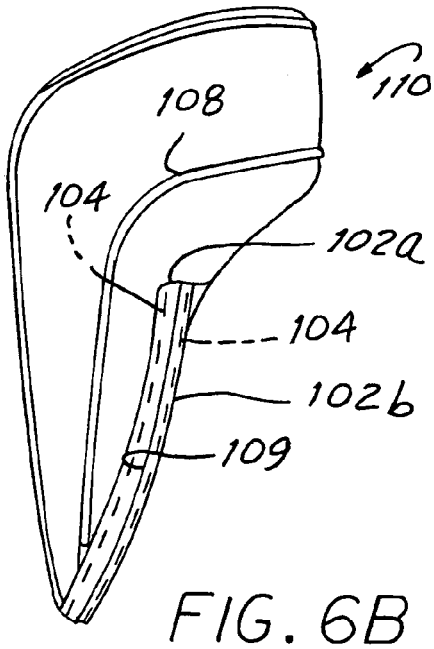
FIG. 6B is a perspective view of a portion of the golf club head cover shown in FIG. 6A in the closed position.

FIGS. 6A and 6B show a sixth embodiment of a golf club head cover 110 using flexible magnetic strips 104. This embodiment discloses an elongate front opening 109 that extends from a golf head portion of the cover to a neck portion. The elongate opening 109 is again formed by flexible magnetic strips 104 enclosed within the centrally located seam material strips 102*a*, 102*b* or piping. The material strips 102*a*, 102*b* may be separate sewn elongate tabs housing the flexible magnetic strips. The separate tabs 102*a*, 102*b* provide a decorative feature. FIG. 6B shows a portion of the golf club head cover 100 when the opening 109 is in a closed position. FIG. 6A shows the golf club head cover 100 when the opening 109 is in an open position. Again the flexible magnetic strips 104 curve to form the oval configured opening. FIG. 6A also shows an optional bottom seam 106 that is visible when the golf club head cover 110 is in an open position. A top seam or piping 108 can be optionally added for decorative purposes.

While the invention has been described in connection with what is presently considered to be the most practical and preferred embodiment, it is to be understood, that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In a golf club head cover having an essentially flexible, non-rigid material construction forming a cavity therein, said construction having at least a first panel and an adjacent panel connected together by seams and an opening between the first panel and the adjacent panel for receiving the golf club head therethrough for storage in the cavity, said opening having an elongate configuration and a closure for the opening, the improvement comprising:

the closure formed from a single flexible magnetic strip enclosed in a seam at one edge of the opening and another single flexible magnetic strip of opposite polarity enclosed in an adjacent seam at the other edge of the opening, wherein each of the single flexible magnetic strips is flexible to follow the elongate configuration; and wherein the first panel is a back panel and the golf club head cover has a bottom section and a pair of side panels and the bottom section is connected to the back panel at a first seam, wherein the opening is located between the back panel and the pair of side panels, and wherein the back panel pivots about the first seam to move between an open and closed position.

2. The improvement of claim 1, wherein each of the single magnetic strips is one of a contiguous flexible flat strip and a contiguous flexible cylindrical strip extending essentially the length of the opening.

3. The improvement of claim 1, wherein the opening has a U-shaped configuration and each of the single magnetic strips conforms to at least a portion of the U-shaped configuration.

4. The improvement of claim 1, wherein each of the single magnetic strips is a contiguous flexible cylindrical strip extending essentially the length of the opening.

5. The improvement of claim 1, wherein the opening has an access port for disposition of a golf club shaft located at an opposing end of the pair of side walls from the first seam.

* * * * *